US009784277B2

(12) United States Patent
Scouarnec

(10) Patent No.: US 9,784,277 B2
(45) Date of Patent: Oct. 10, 2017

(54) MOTOR VEHICLE FAN OF REDUCED AXIAL SIZE

(71) Applicant: Valeo Systemes Thermiques, Le Mesnil Saint Denis (FR)

(72) Inventor: Denis Scouarnec, Versailles (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 261 days.

(21) Appl. No.: 14/394,942

(22) PCT Filed: Mar. 22, 2013

(86) PCT No.: PCT/EP2013/056141
§ 371 (c)(1),
(2) Date: Oct. 16, 2014

(87) PCT Pub. No.: WO2013/156254
PCT Pub. Date: Oct. 24, 2013

(65) Prior Publication Data
US 2015/0071776 A1 Mar. 12, 2015

(30) Foreign Application Priority Data
Apr. 16, 2012 (FR) ..... 12 53462

(51) Int. Cl.
*F04D 19/00* (2006.01)
*F04D 29/16* (2006.01)
*F01P 1/00* (2006.01)

(52) U.S. Cl.
CPC ..... *F04D 19/002* (2013.01); *F01P 1/00* (2013.01); *F04D 29/164* (2013.01)

(58) Field of Classification Search
CPC ..... F04D 19/002; F04D 29/164; F04D 29/52; F04D 29/522; F04D 29/526; F04D 29/545; F04D 29/547; F01D 1/00
See application file for complete search history.

(56) References Cited

U.S. PATENT DOCUMENTS 3,433,403 A * 3/1969 Gerlitz ..... F04D 29/547 138/39
4,566,852 A 1/1986 Hauser
(Continued)

FOREIGN PATENT DOCUMENTS

CA WO 2009062292 A1 * 5/2009 ..... F04D 29/164
DE 90 16 496 U1 3/1991
(Continued)

OTHER PUBLICATIONS

International Search Report for Application No. PCT/EP2013/056141 dated Jun. 18, 2013, 6 pages.
(Continued)

*Primary Examiner* — Richard Edgar
(74) *Attorney, Agent, or Firm* — Howard & Howard Attorneys PLLC

(57) ABSTRACT

A fan for a motor vehicle includes an impeller formed by multiple blades (3) extending radially from a hub (4), and a base supporting the impeller. The impeller is rotated about an axis of rotation by an actuator means and is positioned inside a hollow cylindrical cavity having the same axis and formed by an axial wall (25) attached to the base. The base includes an upstream front wall (22) extending externally in a radial plane with reference to the axis, and an outer wall (23) extending axially from the front wall (22). The front wall (22) has a protrusion (24) bordering the impeller, with the protrusion extending axially upstream with respect to the plane of the front wall (22). The upstream end of the protrusion is situated further upstream than the upstream end of the blades (3) of the impeller.

10 Claims, 3 Drawing Sheets

(56) References Cited

U.S. PATENT DOCUMENTS

| | | | | |
|---|---|---|---|---|
| 5,489,186 | A | 2/1996 | Yapp et al. | |
| 5,730,583 | A * | 3/1998 | Alizadeh | F04D 19/002 416/169 A |
| 7,789,622 | B2 * | 9/2010 | Acre | F04D 29/164 415/209.3 |
| 8,573,931 | B2 | 11/2013 | Blass et al. | |
| 2002/0015640 | A1 | 2/2002 | Nishiyama et al. | |

FOREIGN PATENT DOCUMENTS

| | | | | |
|---|---|---|---|---|
| DE | 19638518 | A1 * | 4/1998 | F04D 19/002 |
| EP | 2 236 788 | A1 | 10/2010 | |
| WO | WO 2009/062292 | A1 | 5/2009 | |

OTHER PUBLICATIONS

Machine-Assisted English translation for DE 90 16 496 extracted from the espacenet.com database on Nov. 6, 2014, 9 pages.
English language abstract for EP 2 236 788 extracted from espacenet.com database on Nov. 6, 2014, 1 page.

* cited by examiner

MOTOR VEHICLE FAN OF REDUCED AXIAL SIZE

RELATED APPLICATIONS

This application is the National Stage of International Patent Application No. PCT/EP2013/056141, filed on Mar. 22, 2013, which claims priority to and all the advantages of French Patent Application No. 12/53462, filed on Apr. 16, 2012, the content of which is incorporated herein by reference.

The field of the present invention is that of the motor vehicle, and more particularly that of the circulation of air for cooling equipment of the vehicle, and in particular its engine.

The vehicles with a combustion engine need to evacuate the heat generated by their operation and for that purpose are equipped with heat exchangers, in particular cooling radiators, which are placed at the front of the vehicle and which are traversed by outside air. To force the circulation of this air through the exchanger or exchangers, a fan is placed upstream or downstream thereof, the upstream or downstream direction being understood in this document to refer to the air flow direction. The impeller which serves to force the air circulation is characterized by a high throughput and a low pressure and has a flow oriented in a very axial manner.

The fan generally comprises a nozzle or base, of parallelepipedal shape, which is traversed at its center by a hollow cylindrical cavity in which the impeller is positioned. This base is used to attach the fan to a support, in particular the cooling radiator or the chassis, and also to support the electric motor which actuates the impeller and to hold the axle about which said impeller rotates. Moreover, aerodynamically, it forms a front obstacle for the air flow, thereby forcing it to be directed toward the impeller.

In fans of the prior art, the impeller is flush and/or is inserted axially, in the downstream direction, with respect to the front plane of the support, as can be seen in FIGS. 1 to 3. The impeller is configured such that the air which circulates on the upstream face of the front wall of this support overcomes an offset in level as it flows into the impeller. It then follows a plunging trajectory toward the impeller, which is favorable for its mixing with the main air flow which, for its part, arrives in a purely axial direction.

This configuration has, on the other hand, the disadvantage of too large an axial extension for the fan, the lateral walls of the base extending in the upstream direction from this front plane, which is therefore situated at an axially more upstream position than the upstream plane of the impeller. For reasons of overall size of the fan and taking into account the severe constraints imposed on motor vehicle front end equipment at this point, it is important to optimize the axial size of the fan, without, however, degrading the aerodynamic performance thereof.

The object of the present invention is to overcome these disadvantages by providing an improved fan, with a minimum axial size.

To this end, the subject of the invention is a fan for a motor vehicle, comprising an impeller formed by multiple blades and a base supporting the impeller, said impeller being rotated about an axis of rotation, said base comprising an upstream front wall extending externally in a radial plane with reference to said axis, and an outer wall extending axially from said front wall.

According to the invention, said front wall has a protrusion bordering the impeller, said protrusion extending axially upstream with respect to the plane of said front wall, and the upstream end of which is situated further upstream than the upstream end of the blades of said impeller.

The presence of this protrusion at the inner level of the front wall makes it possible, while limiting aerodynamic losses, to set back the outer part of the wall in the downstream direction and thus to set back its outer wall which participates directly in the definition of the axial size of the fan.

According to various embodiments which may be taken together or separately:

- said protrusion is circular, surrounding the impeller,
- the blades are connected externally to a shroud,
- said front wall is positioned axially in the same plane as said upstream end of the blades and/or of the shroud,
- said front wall is positioned axially downstream of said upstream end of the blades and/or of the shroud,
- the impeller is positioned inside a hollow cylindrical cavity having the same axis and formed by an axial wall attached to the base such that said cylindrical cavity is situated facing, in particular, an outer end of the blades,
- said protrusion has the form of an axisymmetric rib entirely situated radially outside the outer end of the blades or of the shroud and attached to the axial wall of said cylindrical cavity,
- said rib has, in radial section, a shape whose slope is continuously variable between said upstream front wall and said axial wall,
- said rib is attached to said axial wall in an axial direction or is oriented in a radial plane at its junction with said axial wall,
- said protrusion has the form of an axisymmetric rib which extends as far as an inner radial end positioned radially inside the outer end of the blades or of the shroud, such as to be attached, in particular, to the axial wall of the cylindrical cavity,
- the axisymmetric rib forms a guide duct for the flow circulating between the shroud and the axial wall,
- said axisymmetric rib has, in radial section, a shape whose slope is continuously variable between the radial part of said upstream front wall and its inner radial end,
- said rib is attached to said axial wall in an axial direction from said inner radial end,
- said rib is oriented in a radial plane at its inner radial end.

As indicated further above, said front wall is advantageously positioned axially downstream of said upstream end of the blades and/or of the shroud. This very set-back position of the front wall makes it possible to reduce the axial size of the fan.

The invention also relates to a motor vehicle cooling module comprising a fan as described above. A motor vehicle engine block cooling module is an assembly comprising in particular a fan and a heat exchanger such as a cooling radiator.

The invention will be better understood, and other aims, details, features and advantages thereof will become more clearly apparent, from the following detailed explanatory description of a number of embodiments of the invention given by way of nonlimiting and purely illustrative examples with reference to the appended schematic drawings.

Figure 1:
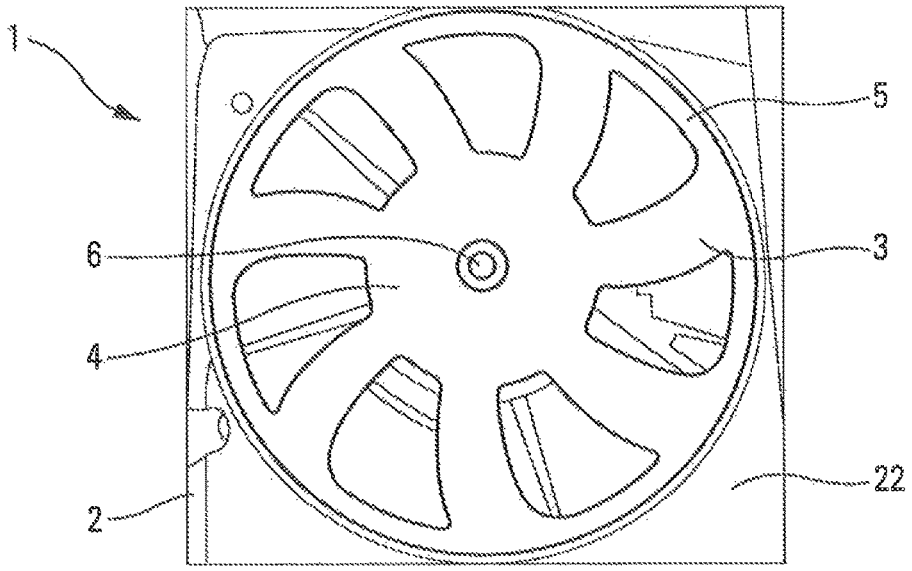
FIG. 1 is a front view, from the upstream direction, of a fan for a motor vehicle, according to the prior art.
Figure 2:
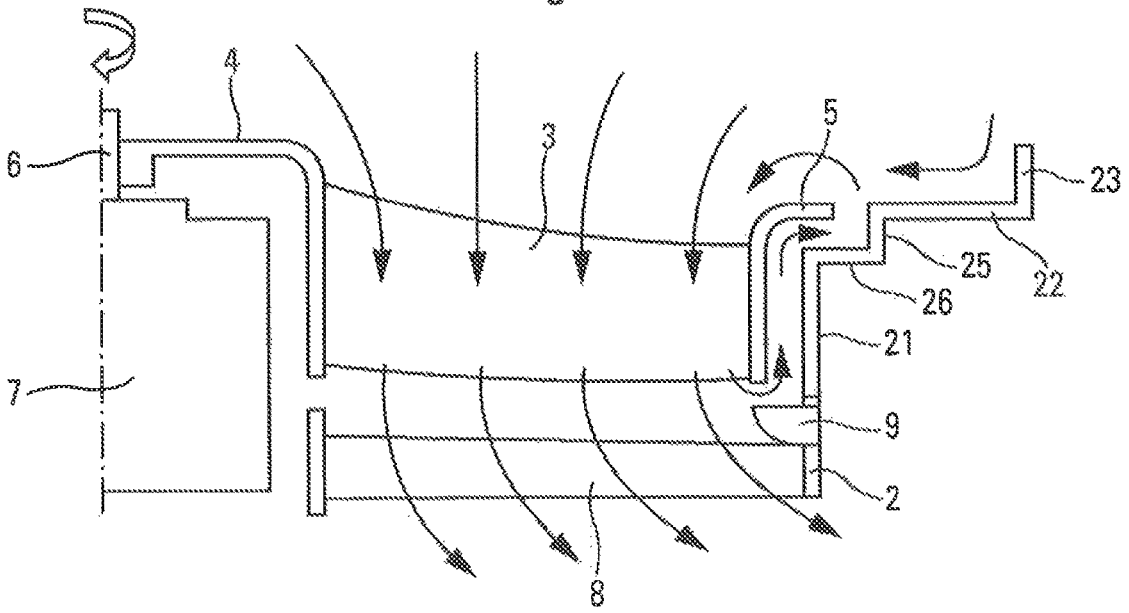
FIG. 2 is a schematic view in radial section of the fan of FIG. 1.

FIG. 1 shows a front view of a fan 1 in which an impeller is inserted into a hollow cylindrical cavity placed at the center of a base 2 of parallelepipedal shape. The base has a substantially planer front wall 22 facing the ventilation air flow and an outer wall 23 which surrounds the front wall 22 and which forms a duct for feeding air into the fan 1. The impeller of the fan comprises a series of blades 3 which are attached, at their central end, to a hub 4 and, here, at their peripheral end, to a circular shroud 5. The fan 1 turns about a central axis 6 driven by an actuator means, in particular an electric motor 7 (visible in FIG. 2). FIG. 2 shows stator vanes 8 positioned downstream of the blades 3, the object of which is to serve as a support for the electric motor 7 and as a guide for the air flow leaving the fan. As on all fans there is an air recirculation current which passes from the downstream direction of the fan upstream while running around the ends of the blades 3 and which should be minimized. For this purpose, there has already been proposed a ring 9 in the form of a quarter-torus, visible in FIG. 2, which is placed between the downstream end of the blades 2 and the upstream end of the stator vanes 8 and which extends radially from the outer wall toward the inside of the fan. This quarter-torus 9 has the aim, using the Coanda effect, of preferentially deviating the air flow downstream of the blades 2 toward the stator 8 and thus preventing it from being oriented to the periphery, in the direction of the walls of the base 2, and from supplying the recirculation circuit. The Coanda effect consists in an attraction of a fluid jet by a wall when it circulates close thereto. It is generally used for producing a deviation of the orientation of the jet, choosing a curved wall for the wall, which is the case here with the quarter-torus shape of the ring 9.

To reduce this recirculation flow further still, the shroud 5 has been given, in radial section, an L shape, the axial branch of which forms the support for the ends of the blades 3 and the radial branch of which covers the radially innermost cylindrical part 21 of the support 2. This inner radial part 21 forms the cylindrical cavity in which the impeller is positioned. To house the radial branch of the shroud 5, the support 2 has consequently been modified with the introduction of a shoulder formed by an L-shaped cutout between its inner radial part 21 and its front wall 22. This L-shaped cutout has a first radial wall 26, which is parallel to the radical branch of the shroud 5, and an axial wall 25 which faces this end of the radial branch of the shroud and which is connected to the front wall 22 of the base. Finally, as indicated above, the outer wall 23 is attached to the outer radial end of the front wall 22, said outer wall extending axially and forming a duct for feeding air into the fan. Axially, this outer wall 23 extends from the front wall 22 over a length which is determined by mechanical strength considerations for the assembly and which cannot be reduced without a harmful consequence.

Figure 3:
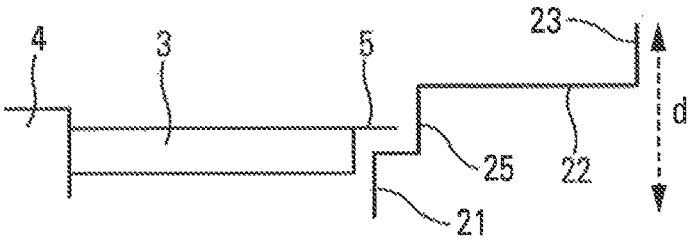
FIG. 3 is a simplified schematic view of FIG. 2.

The resulting axial spacing between the upstream face of the shroud 5 and the upstream end of the outer wall 23 increases the overall axial size d of the fan, as can be seen in FIG. 3. This is what the invention proposes to correct.

Figure 4:
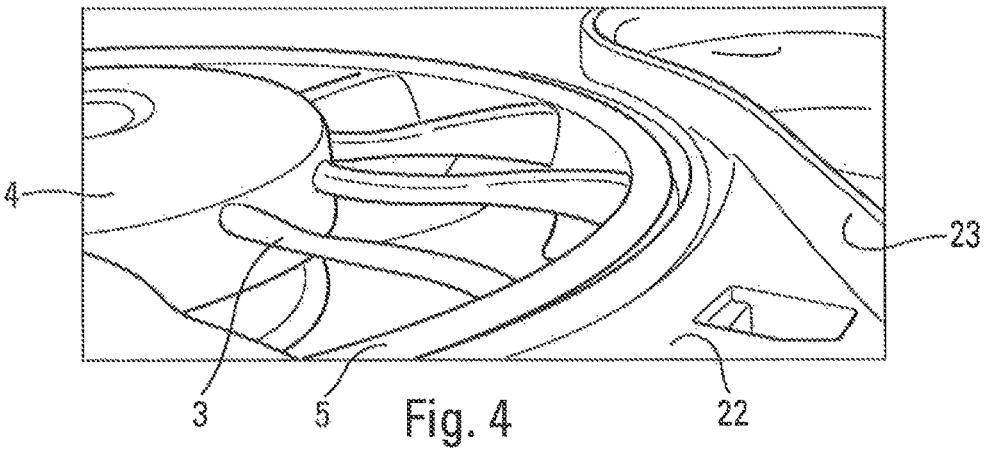
FIG. 4 is a perspective view of a fan for a motor vehicle, according to one embodiment of the invention.

FIG. 4 shows a fan according to a first embodiment of the invention. The front wall 22 of the base 2 is not planar, as is the case in the prior art, but it has, at its inner radial end, a protrusion in the form of a lip 24 which extends upstream from the front wall 22 and which is connected, in an axial direction, to the axial wall 25 of the L-shaped cutout of the support 2. Consequently, the front wall 22 of the support 2 is in a position less advanced in the upstream direction with respect to the upstream face of the shroud 5 than in the prior art. In addition, therefore, the outer wall 23, which extends from this front wall and which may have the same axial extension as in the prior art, is, for its part too, less advanced axially with respect to the upstream face of the hub 4 or of the shroud 5. The axial size d of the fan is thus reduced.

Figure 5:
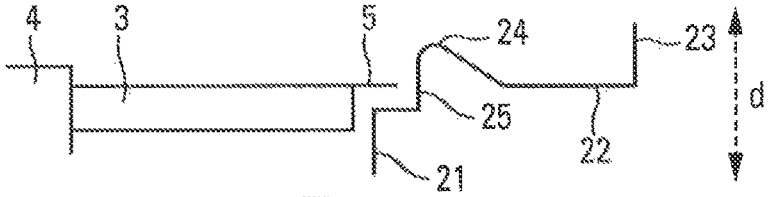
FIG. 5 is a simplified schematic view, in radial section, of the fan of FIG. 4, in a first embodiment.

FIG. 5 shows, in a simplified manner, a first variant of the fan in the first embodiment. According to this variant, the lip 24 is inflected, going from the periphery inward, with a shape whose slope changes continuously, without break, before joining up with the axial wall 25 in an axial direction while being tangential thereto.

Figure 6:
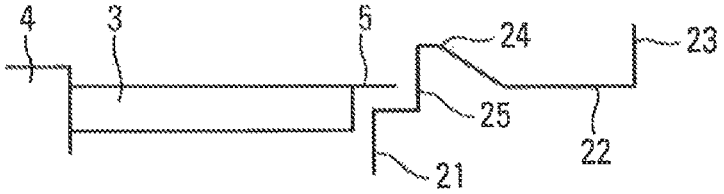
FIG. 6 is a simplified schematic view, in radial section, of the fan of FIG. 4, in a variant of the first embodiment.

In FIG. 6, which shows a second variant of the first embodiment, the axial position of the front wall 22 is unchanged with respect to the first variant, so as to keep the saving obtained in terms of the overall axial size d. But, by contrast with the first variant, the lip 24 has a break in its slope with a right angle at its connection with the axial wall 25 of the L-shaped cutout. The slope of the lip thus changes continuously until reaching a radial orientation, precisely where the lip is connected to the axial wall 25.

In the first variant, the air which runs along the front part is subjected to a Coanda effect associated with the curve shape of the lip 24 and is directed more axially as it arrives at the end of the blades 3, thereby facilitating its mixture with the main air flow which traverses them. The second variant promotes, for its part, the return of the circulation air at the end of the blades toward the main flow, injecting the flow circulating along the front wall 22 in a radial direction, above the recirculation circuit.

Figure 7:
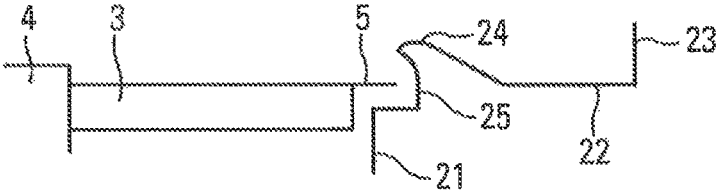
FIG. 7 is a simplified schematic view, in radial section, of the fan of FIG. 4, in a second embodiment.
Figure 8:
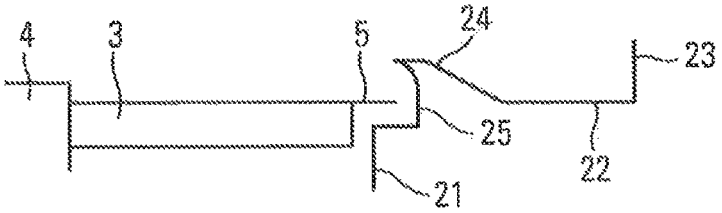
FIG. 8 is a simplified schematic view, in radial section, of the fan of FIG. 4, in a variant of the second embodiment.

FIGS. 7 and 8 show, for their part, two variants of a second embodiment of the invention. In this second embodiment, the lip 24 is extended, at its most upstream part, toward the inside of the fan, such that it protrudes beyond and covers the outer radial end of the shroud 5. FIG. 7 represents the first variant with, as above, a rounded apex which is inflected, coming toward the inside, in the direction of the axial direction. Beyond this apex, the lip 24 is terminated by a turned-in point, from which it returns toward the outside while being directed downstream, in order to join up with the axial wall 25 of the L-shaped cutout in an axial orientation. This rounded shape makes it possible, as in the first embodiment, for the air flow which circulates along the front wall 22 to benefit from the Coanda effect and to straighten it in a more axial direction.

FIG. 8 represents the second variant of the second embodiment with, as above, a radial orientation at the apex of the lip. In the same manner, it has a turned-in point and returns outward while being directed downstream, in order to join up with the axial wall 25 of the L-shaped cutout in an axial orientation. This second variant promotes, for its part too, the return, toward the main flow, of the circulation air at the end of the blades, by injecting the flow which circulates along the front wall 22 in a radial direction, above the recirculation circuit.

In the above FIGS. 5 to 8, the front wall 22 is positioned axially in the same plane as said upstream end of the blades 3 and/or of the shroud 5.

Figure 9:
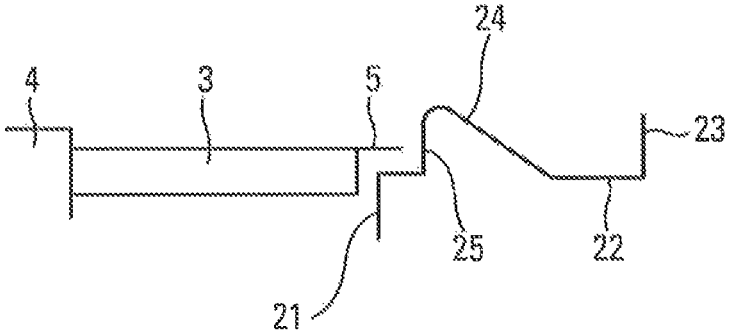
FIG. 9 is a simplified schematic view, in radial section, of the fan of FIG. 4, in an additional variant of the first embodiment.

As illustrated in FIG. 9, this may also be situated downstream. It is here illustrated with a protrusion identical to that of FIG. 5 but it could of course be a protrusion having different shapes such as those illustrated in FIGS. 6 to 8.

The principle of the invention therefore consists, with respect to the prior art, in reducing the axial size of the fan by offsetting downstream the front wall 22, and more particularly its upstream face, forming the front face of the parallelepipedal support 2, while keeping the same length for the outer wall 23. In order to compensate for this offset of the front wall 22 and once again find the improved aerodynamic operation which is associated with an injection of air circulating on the front wall 22 above the peripheral shroud 5, a lip 24 is introduced at the inner radial end of this front wall 22. This lip has the form of a rib, for example a rounded circular rib, which extends axially upstream above the front wall 22 and which is here connected in an axial orientation to the axial wall 25 facing the shroud 5. Thus, the air circulating on the front wall 22 is raised upstream to be injected into the main air flow without generating a vortex and therefore creating the least possible disturbance in this main flow.

In the second embodiment, the lip 24 is extended above the outer radial end of the shroud 5, thus forming a guide duct for the recirculation flow which circulates between the shroud 5 and the axial wall 25 of the support 2. Moreover, it serves as a separator between the recirculation flows and the flow circulating on the front wall 22 prior to its injection into the main flow which traverses the blades 3.

In a variant, not shown, of the second embodiment, it is possible to install guides below the part of the lip 24 which extends between the turned-in point and the axial wall 25, in order to straighten the recirculation flow and prevent it from acquiring a tangential speed by an entrainment effect of the shroud. These guides are plates oriented essentially radially which extend from the inner circle to the lip 24 and which have, on the opposite side to this circle, either a diagonal or curved edge facing the end of the shroud 5. By reducing the tangential component of the recirculation flow, it is thus possible to better manage the mixing thereof with the main flow.

The invention claimed is:

1. A fan for a motor vehicle, said fan comprising an impeller formed by multiple blades (3) and a base (2) supporting said impeller, said impeller being rotated about an axis of rotation (6), said base comprising an upstream front wall (22) extending externally in a radial plane with reference to said axis, and an outer wall (23) extending axially from said front wall (22), wherein said front wall (22) has a protrusion (24) bordering said impeller, said protrusion extending axially upstream with respect to the plane of said front wall (22), and the upstream end of which is situated further upstream than the upstream end of said blades (3) of said impeller, wherein said blades (3) are connected externally to a shroud (5), wherein said front wall (22) is positioned axially in the same plane as the upstream end of said blades (3) and/or of said shroud (5), and wherein said protrusion has the form of an axisymmetric rib (24) which extends as far as an inner radial end positioned radially inside the outer end of said blades (3) or of said shroud (5).

2. The fan as claimed in claim 1 in which said protrusion is circular, surrounding said impeller.

3. The fan as claimed in claim 1 in which said impeller is positioned inside a hollow cylindrical cavity having the same axis and formed by an axial wall (25) attached to said base (2).

4. The fan as claimed in claim 1 in which said rib (24) has, in radial section, a shape whose slope is continuously variable between said front wall (22) and said axial wall (25).

5. The fan as claimed in claim 1 in which said rib (24) is attached to said axial wall (25) in an axial direction or is oriented in a radial plane at its junction with said axial wall (25).

6. The fan as claimed in claim 1 in which said rib (24) forms a guide duct for the flow circulating between said shroud (5) and said axial wall (25).

7. The fan as claimed in claim 6 in which said rib (24) has, in radial section, a shape whose slope is continuously variable between the radial part of said front wall (22) and its inner radial end.

8. The fan as claimed in claim 1 in which said rib (24) is attached to said axial wall (25) in an axial direction.

9. The fan as claimed in claim 1 in which said rib (24) is oriented in a radial plane at its inner radial end.

10. A motor vehicle cooling module comprising a fan as claimed in claim 1.

* * * * *